US005124680A

United States Patent [19]

Maekawa

[11] Patent Number: 5,124,680

[45] Date of Patent: Jun. 23, 1992

[54] CASED TRANSFORMER

[75] Inventor: Toshio Maekawa, Himeji, Japan

[73] Assignee: Mitsubishi Denki Kabushiki Kaisha, Tokyo, Japan

[21] Appl. No.: 737,759

[22] Filed: Jul. 30, 1991

[30] Foreign Application Priority Data

Aug. 1, 1990 [JP] Japan ..... 2-81139[U]

[51] Int. Cl.[5] ..... H01F 15/10; H01F 27/04

[52] U.S. Cl. ..... 336/96; 336/107; 336/192; 336/198

[58] Field of Search ..... 336/96, 105, 107, 192, 336/198; 123/634

[56] References Cited

U.S. PATENT DOCUMENTS 4,509,033 4/1985 Weiss et al. ..... 336/96 X 4,763,094 8/1988 Kojima ..... 336/107

*Primary Examiner*—Thomas J. Kozma

*Attorney, Agent, or Firm*—Sughrue, Mion, Zinn, Macpeak and Seas

[57] ABSTRACT

A cased transformer having a coil unit including a bobbin, primary and secondary coils and a cavity inside the bobbin, a core extending through the cavity, primary external connection terminals for leading two ends of the primary coil outside the case, secondary external connection terminals located on opposite sides of the case and having inner ends connected to two ends of the secondary coil inside the case and outer ends led to the outside. The case has an accommodation portion in which the coil unit is accommodated, an opening side which faces one of the two ends of the secondary coil, through which the coil unit is inserted into the accommodation portion and through which the operation of connecting the one end of the secondary coil and the inner end of the corresponding one of the secondary terminals is performed, embedment portions in which the pair of secondary terminals are embedded, and an opening which is formed in the vicinity of the other end of the secondary coil, through which an operation of connecting the other end of the secondary coil and the inner end of the other secondary terminal is performed. The cased transformer also has a cap for closing the opening, and a thermosetting resin or the like injected into the accommodation portion through the case opening side to fix components in the accommodation portion while electrically insulating them and to fix the primary terminals on the opening side.

8 Claims, 2 Drawing Sheets

CASED TRANSFORMER

BACKGROUND OF THE INVENTION

1. Field of the Invention

This invention relates to an ignition coil having a structure such that a transformer is housed in a case and, more particularly, to an ignition coil which requires connecting high-tension terminals and coil ends inside a case.

2. Description of the Related Art

FIGS. 5, 6, and 7 show a conventional ignition coil; FIG. 5 is a top view; FIG. 6 is a side view; and FIG. 7 is a vertical longitudinal sectional view. FIG. 6 shows a side of the ignition coil viewed from the left hand side of FIG. 7.

A coil unit 1 is accommodated in an accommodation portion 2*b* of a case 2. In a coil unit 1, a primary coil 1*a* and a secondary coil 1*b* are wound around a bobbin 1*c*, the primary coil 1*a* being wound inside the secondary coil 1*b*. The primary coil is a low-tension coil connected to a battery (not shown), and the secondary coil 1*b* is a high-tension coil connected to spark plugs (not shown).

The case 2 is formed by, for example, molding a plastic or the like. High-tension terminals 3*a* and 3*b* are external connection terminals of the secondary coil 1*b* and these terminals 3*a* and 3*b* are embedded in the case 2. The high-tension terminal 3*a* is a long terminal extending from the right side of the case 2 to the left end of the accommodation portion 2*b* as shown in the figures, and is connected to an extensional portion 4*a* of the secondary coil 1*b*, i.e., the left end of this coil by a solder 7 (FIG. 7). The high-tension terminal 3*b* is a short terminal extending from the right side of the case 2 to the right end of the accommodation portion 2*b*, and is also connected to an extensional portion 4*b* of the secondary coil 1*b*, i.e., the right end of this coil by the solder 7. The operation of connecting these high-tension terminals 3*a* and 3*b* and the extensional portions 4*a* and 4*b* by soldering is performed through an opening side 2*a* indicated by arrows B1 and B2 in FIG. 7. The high-tension terminals 3*a* and 3*b* respectively have at their right ends female connection portions 3*a* and 3*d* for connection on the outside of the case 2.

A core 5 has upper portions one of which extends into a cavity 1*d* of the coil unit 1 through another opening formed on the case 2, and the other of which extends into the cavity 1*d* through the opening side 2*a*. Lower portions of the core 5 are connected below the case 2. The core 5 can be separated into two parts and is formed by joining two parts together from both sides of the case 2 so that they are fitted in the coil unit 1 and the case 2, as shown in FIG. 7.

An epoxy resin 6 (FIG. 6) is injected into the accommodation portion 2*b* to fix the parts in the accommodation portion 2*b* while electrically insulating these parts. More specifically, the ignition coil is positioned so that the opening side 2*a* faces upward, and a thermosetting epoxy resin 6 is injected into the accommodation portion 2*b* in the direction of an arrow A of FIG. 5 so that the epoxy resin 6 enters gaps between the parts in the accommodation portion 2*b*, that is, the accommodation portion 2*b* is filled with the epoxy resin 6. Thereafter the epoxy resin 6 is set by being heated, and the parts accommodated in the accommodation portion 2*b* are thereby fixed and electrically isolated from each other. A pair of low-tension terminals 8 is provided as external connection terminals for the primary coil 1*a* and the terminals 8 are fixed in such a manner as to be exposed outside the case 2 through the opening side 2*a* when the epoxy resin 6 is injected. The pair of low-tension terminals 8 are connected to two ends of the primary coil 1*a* via, for example, lead wires 8*a*, but details of this connection are omitted in the figures and will not specifically be described. Although the epoxy resin is indicated by a reference numeral 6 in FIG. 6, each figure shows a state in which the epoxy resin is removed for ease of explanation of the internal structure of the ignition coil.

As mentioned above, for conventional ignition coils, the operation of soldering the high-tension terminals and the extensional portions which are the ends of the high-tension secondary coil is performed through one opening side of the case, as indicated by arrows B1 and B2 in FIG. 7. To connect the high-tension terminal and the extensional coil end portions on the side of the case remote from the opening side, it is necessary to increase the size of the case by considering the space for enabling soldering. Also, the size of the case is increased for another reason that since the high-tension terminals extend from one side of the coil, the height of the extensional portions of the secondary coil must be increased to prevent contact between the coil and the high-tension terminal extending over the coil.

SUMMARY OF THE INVENTION

In view of these problems, an object of the present invention is to provide an ignition coil which can be reduced in size.

In order to achieve this object, according to the present invention, there is provided a cased transformer requiring operations of electrically connecting coil ends and external connection terminals inside a case, comprising a coil unit including a bobbin, a primary coil wound around the bobbin in an inner position and having two ends, a secondary coil wound around the bobbin in an outer position and having two ends, and a cavity existing inside the primary coil; a core extending through the cavity of the coil unit; primary external connection means for leading the two ends of the primary coil to outside of the case; secondary external connection means including a pair of secondary external connection terminals, inner ends of the secondary external connection terminals extending to positions such as to be able to contact with the two ends of the secondary coil, the inner ends being electrically connected to the two ends of the secondary coil inside the case, outer ends of the secondary external connection terminals extending to the outside of the case on the same sides as the corresponding inner ends; the case having an insulating property, the case including an accommodation portion in which the coil unit is accommodated, an opening side defined at a position such as to face one of the two ends of the secondary coil, the coil unit being inserted into the accommodation portion through the opening side, an operation of electrically connecting the one end of the secondary coil and the inner end of the corresponding one of the secondary external connection terminals being performed through the opening side, embedment portions in which the pair of secondary external connection terminals are embedded, and an opening formed in the vicinity of the other of the two ends of the secondary coil, an operation of electrically connecting the other end of the secondary coil and the inner end of the other of the secondary external connection terminals being performed through the opening; a cap for closing the opening; and insulating/fixing means injected into the accommodation portion through the opening side of the case to fix components in the accommodation portion while electrically insulating the components, the insulating/fixing means also fixing the primary external connection means on the opening side while enabling external connection of the primary external connection means.

According to the present invention, two high-tension terminals provided as the secondary external connection terminals are provided on the opening side of the case and the other side opposed from the opening side respectively, so that the high-tension terminals extend to the two coil ends of the secondary coil of the coil unit, to which they are to be connected, from the corresponding sides respectively. The operation of connecting one of the high-tension terminals and the corresponding one of the coil ends is performed through the opening side, while the operation of connecting the other high-tension terminal and the other coil end is performed through the other opening formed on the side remote from the opening side.

DESCRIPTION OF THE PREFERRED EMBODIMENT

Figure 1:
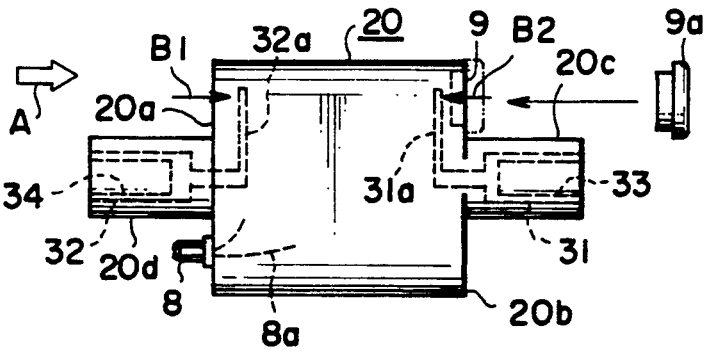
FIG. 1 is a top view of an ignition coil in accordance with an embodiment of the present invention.
Figure 2:
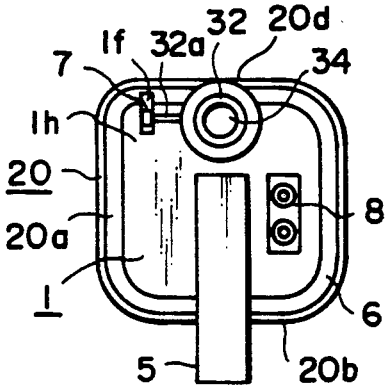
FIG. 2 is a side view of the ignition coil shown in FIG. 1.
Figure 3:
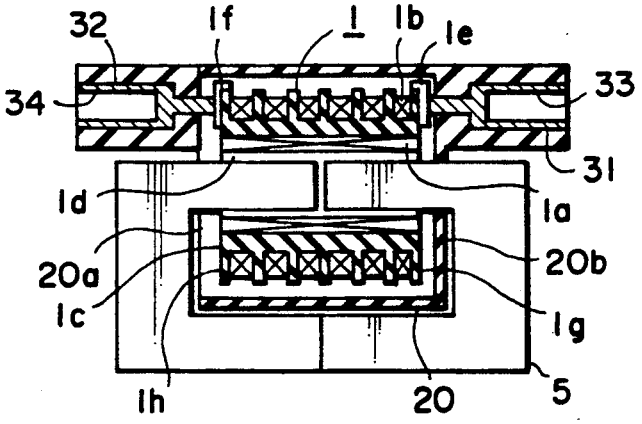
FIG. 3 is a vertical longitudinal sectional view of the ignition coil shown in FIG. 1.
Figure 4:
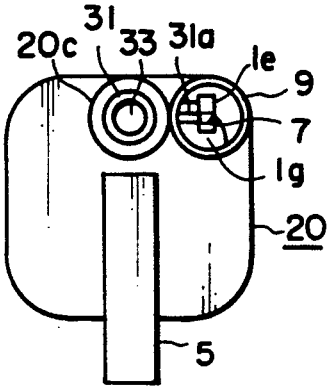
FIG. 4 is a side view of the ignition coil shown in FIG. 1 in the direction opposite to that of FIG. 2.

FIGS. 1 to 4 show an ignition coil in accordance with an embodiment of the present invention; FIG. 1 is a top view; FIG. 2 is a left side view; FIG. 3 is a vertical sectional view; and FIG. 4 is a right side view.

Figure 5:
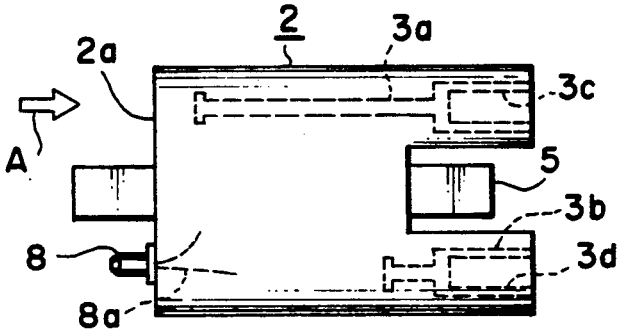
FIG. 5 PRIOR ART
FIG. 5 is a top view of the conventional ignition coil.
Figure 6:
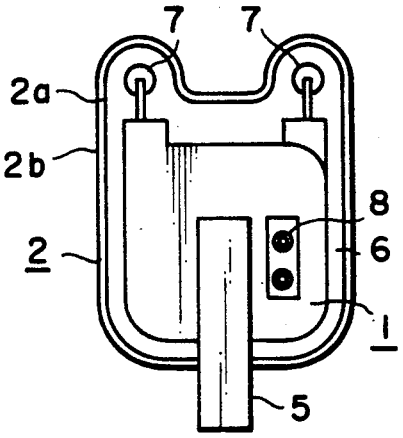
FIG. 6 PRIOR ART
FIG. 6 is a side view of the ignition coil shown in FIG. 5.
Figure 7:
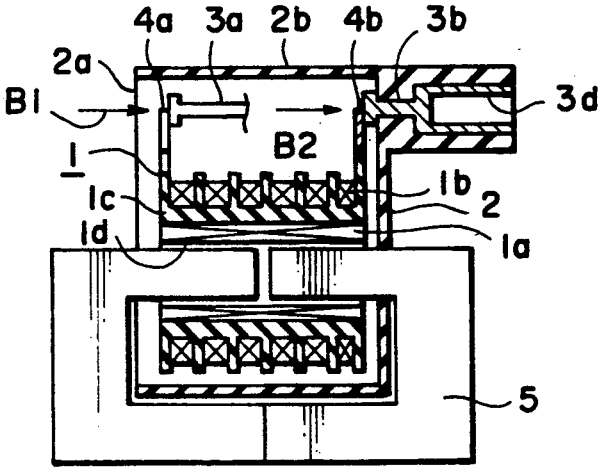
FIG. 7 PRIOR ART
FIG. 7 is a vertical longitudinal sectional view of the ignition coil shown in FIG. 5.

In FIGS. 1 to 4, components identical or corresponding to those of the conventional ignition coil shown in FIGS. 5 to 7 are indicated by the same reference characters.

In this ignition coil of the present invention, a case 20 is formed of a material having an electrically insulating property, e.g., a plastic, by molding. The case 20 has an accommodation portion **20*b* in which a coil unit 1 is accommodated, an opening side 20*a* through which the coil 1 is accommodated in the accommodation portion 20*b*, embedment portions 20*c* and 20*d* which are formed on opposite sides of the accommodation portion 20*b* and in which high-tension terminals 31 and 32 are embedded, and an opening 9 formed in a portion of the accommodation portion 20*b* on the side opposed from the opening side 20*a*. The opening 9 is closed by a cap 9*a***.

The pairs of high-tension terminals 31 and 32 which are secondary external connection terminals have their outer portions formed as female connection portions 33 and 34 for external connection, and their inner portions formed as bent portions **31*a* and 32*a* which extend horizontally from the female connection portions into the interior of the accommodation portion 20*b* and are generally bent perpendicularly. The inner ends of the bent portions 31*a* and 32*a* respectively extend toward connection portions 1*e* and 1*f* which are both coil ends of a secondary coil 1*b*, and are electrically connected to these connection portions 1*e* and 1*f* by, for example, a solder 7. The female connection portions 33 and 34 are embedded in the embedment portions 20*c* and 20*d*. The female connection portions 33 and 34** are connected to, for example, spark plugs via high-tension codes (both not shown).

The coil unit 1 includes a bobbin **1*c*, a primary coil wound around the bobbin 1*c* in an inner position, a secondary coil 1*b* wound around the bobbin 1*c* in an outer position, and a cavity 1*d* existing inside the primary coil 1*a*. A diameter or a girth of the bobbin 1*c* is slightly greater than that of the secondary coil 1*b*, and the bobbin 1*c* has external side surfaces 1*g* and 2*h* formed at its opposite ends. Coil end connection potions 1*e* and 1*f* of the secondary coil 1*b* are formed on one side end of upper end portions of the external side surfaces 1*g* and 1*h*** respectively.

A core 5 has a structure separable into two parts and is formed by joining two parts together from both sides of the case 20 so that they are fitted in the cavity **1*d* of the coil unit 1 and the case 20, as shown in FIG. 3. A pair of low-tension terminals 8 is provided as a primary external connection means and the terminals 8 are respectively connected to both ends of the primary coil 1*a* via leads 8*a*. These connection terminals 8 are connected to a low-tension-side battery (not shown). After the coil unit 1 has been accommodated in the accommodation portion 20*b* of the case 20 and then the electrical connection for the all ends of the coils 1*a* and 1*b* has been completed, an epoxy resin 6 (FIG. 2) which is served as insulating/fixing means is injected into the accommodation portion 20*b***. Each figure shows a state in which the epoxy resin is removed for ease of explanation of the internal structure of the ignition coil, in the same way as the case of the explanation of the conventional ignition coil.

The structure of the ignition coil of the present invention will be described in more detail. The high-tension terminals 31 and 32 are provided at the centers of opposite sides of the accommodation portions **20*b* of the case 20 and are positioned in the vicinity of the two coil ends of the secondary coil 1*b*. There is therefore no need to extend the high-tension terminal over the coil unit and to provide extensional portions on the opposite sides of the bobbin 1*c* of the coil unit 1. The accommodation portion 20*b* and the opening side 20*a* may be formed so as to have a size slightly greater than that of the coil unit 1, as shown in FIG. 2. While the embedment portion 20*c* on the right-hand side is formed integrally with the accommodation portion 20*b*, the left embedment portion 20*d* is fixed to the accommodation portion 20*b* after the coil unit 1 has been accommodated in the accommodation portion 20*b*, because the opening side 20*a* has a limited size slightly larger than the diameter of the bobbin 1*c* of the coil unit 1** as mentioned above.

The bobbin **1*c* of the coil unit 1 has, at its opposite ends, external side surfaces 1*g* and 1*h* having a diameter slightly greater than that of the secondary coil 1*b*, and the coil end connection potions 1*e* and 1*f* of the secondary coil 1*b* are formed on one side ends of the upper end portions of the external side surfaces 1*g* and 1*h* respectively. The inner ends of the bent portion 31*a* and 32*a* of the high-tension terminals 31 and 32 are electrically connected to the connection portions 1*e* and 1*f* by the solder 7. The above operation of connecting the inner end of the high-tension terminal 31 is performed through the opening 9 as indicated by arrow B2 in FIG. 1, while the operation of connecting the inner end of the high-tension terminal 32 is performed through the opening side 21***a* as indicated by arrow B1. Thus, no portion is soldered from a remote side and there is no need to provide a large gap between the bobbin 1*c* and the accommodation portion 20*b*. After the above connection operation has been finished, the opening 9 is closed by the cap 9*a* to prevent the epoxy resin 6 from leaking when the epoxy resin is injected into the accommodation portion 20.

The both ends of the primary coil 1*a* and the low-tension terminals 8 are previously connected through the lead wires 8*a*, for example, before the coil unit 1 is accommodated in the accommodation portion 20*b*.

The core 5 is formed by joining two parts together from the opposite sides so as to be fitted in the case 20 and the coil unit 1, as shown in FIG. 3, thereby forming a closed magnetic circuit which extends through the opening side 20*a* and the cavity 1*c* of the coil unit 1 and passes through one portion of the case 20 to the outside of the case 20 and returns to the opening side 20*a*.

The ignition coil is positioned so that the opening side 20*a* faces upward, and thermosetting epoxy resin 6 is injected into the accommodation portion 20*b* in the direction of arrow A of FIG. 1, and is then heated. The parts accommodated in the accommodation portion 20*b* are thereby fixed and electrically insulated from each other. At this time, the low-tension terminals 8 are fixed in the opening side 20*a* by the epoxy resin 6 so as to enable contact from the outside.

The positions of the two end connection portions 1*e* and 1*f* of the secondary coil 1*b* on the external side surfaces 1*g* and 1*h*, the position and shape of the high-tension terminals 31 and 32 and the position of the opening 9 are not limited to those mentioned above. There is only limitation that the high-tension terminals 31 and 32 are provided on the same sides of the accommodation portion 20*b* of the case 20 as that of the connection portions 1*e* and 1*f* to which they are to be connected. Further the shape of each high-tension terminal may be such that the high-tension terminal extends so as to be able to connect to the connection portion 1*e* or 1*f* in the accommodation portion 20*b*. The opening 9 may be formed in a position such that it is possible to solder the inner end of the high-tension terminal on the side remote from the opening side 20*a* of the case 20 and the connection portion of the corresponding end of the secondary coil. The above embodiment has been described with respect to an ignition coil, but the present invention is not limited to the described ignition coil and is applicable to any other kind of cased transformers In the above-described embodiment, the primary coil is a low-tension coil wound around the bobbin in an inner position while the secondary coil is a high-tension coil wound around the bobbin in an outer position. However, the present invention is applicable to any other transformers so long as the transformer has a structure such that two coil ends of a coil wound around a bobbin in a outer position are connected to external connection terminals inside a case.

What is claimed is:

1. A cased transformer requiring operations of electrically connecting coil ends and external connection terminals inside a case, comprising a case:

a coil unit including a bobbin, a primary coil wound around the bobbin in an inner position and having two ends, a secondary coil wound around the bobbin in an outer position and having two ends, and a cavity existing inside the primary coil;

a core extending through the cavity of said coil unit;

primary external connection means for leading the two ends of said primary coil to outside of said case;

secondary external connection means including a pair of secondary external connection terminals, inner ends of said secondary external connection terminals extending to positions such as to be able to contact with the two ends of said secondary coil, said inner ends being electrically connected to the two ends of said secondary coil inside said case, outer ends of said secondary external connection terminals extending to the outside of said case on the same sides as the corresponding inner ends;

said case having an insulating property, said case including an accommodation portion in which said coil unit is accommodated, an opening side defined at a position such as to face one of the two ends of said secondary coil, said coil unit being inserted into said accommodation portion through said opening side, an operation of electrically connecting one of said two ends of said secondary coil and the inner end of the corresponding one of said secondary external connection terminals being performed through said opening side, embedment portions in which said pair of secondary external connection terminals are embedded, and an opening formed in the vicinity of the other of the two ends of said secondary coil, an operation of electrically connecting the other of said two ends of said secondary coil and the inner end of the other of said secondary external connection terminals being performed through said opening;

a cap for closing said opening; and insulating/fixing means injected into said accommodation portion through said opening side of said case to fix components in said accommodation portion while electrically insulating the components, said insulating/fixing means also fixing said primary external connection means on said opening side while enabling external connection of said primary external connection means.

2. A cased transformer according to claim 1 wherein said primary coil is a low-tension coil, said secondary coil is a high-tension coil, said primary external connection means includes a pair of low-tension terminals and lead wires for connecting said low-tension terminals to the two ends of said primary coil, and said secondary external connection terminals are formed of a pair of high-tension terminals.

3. A cased transformer according to claim 2 wherein a diameter of said bobbin of said coil unit is slightly greater than that of said secondary coil, said bobbin has external side surfaces formed at its opposite ends, and the two ends of said secondary coil have connection portions extending on said external side surfaces, the inner ends of said high-tension terminals being respectively connected to said connection portions.

4. A cased transformer according to claim 3 wherein said two connection portions of said secondary coil are provided on one side end of upper end portions of said opposite-end external side surfaces of said bobbin, said high-tension terminals are provided at upper central portions of opposite sides of said case, said high-tension terminals include female connection portions which extend along the longitudinal direction of said case and which correspond to said outer ends capable of external connection, and bent portions which extend horizontally into the interior of said case from said female connection portions and are bent generally perpendicularly and which have end portions corresponding to said inner ends and connected to said connection portions of said secondary coil, said female connection portions are respectively embedded in said embedment portions, and said opening is formed generally flush with said embedment portions so as to face the end of the corresponding one of said bent portions.

5. A cased transformer according to claim 4 wherein said opening side is slightly greater than said coil unit, said embedment portion provided on the same side as said opening is formed integrally with said accommodation portion, and the other embedment portion provided on the same side as said opening side is fixed to said accommodation portion after said coil unit has been accommodated in said accommodation portion through said opening side.

6. A cased transformer according to claim 5 wherein said connection portions and the inner ends of said high-tension terminals are connected by soldering.

7. A cased transformer according to claim 1 wherein said insulating/fixing means comprises a thermosetting resin and is set by heating after being injected into said accommodation portion.

8. A cased transformer according to claim 1 wherein said cased transformer is an ignition coil.

* * * * *